US006872928B2

(12) United States Patent
Kim et al.

(10) Patent No.: US 6,872,928 B2
(45) Date of Patent: Mar. 29, 2005

(54) DOOR HINGE ASSEMBLY FOR A MICROWAVE OVEN

(75) Inventors: Kyoung Ho Kim, Suwon-Si (KR); Jae Man Cho, Suwon-Si (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 10/837,711

(22) Filed: May 4, 2004

(65) Prior Publication Data

US 2005/0023277 A1 Feb. 3, 2005

(30) Foreign Application Priority Data

Jul. 31, 2003 (KR) ..... 10-2003-0053167

(51) Int. Cl.[7] ..... H05B 6/76

(52) U.S. Cl. ..... 219/739; 219/740; 219/756; 174/35 R

(58) Field of Search ..... 219/739–743, 219/722–724, 756; 174/35 R

(56) References Cited

FOREIGN PATENT DOCUMENTS

| | | | |
|---|---|---|---|
| JP | 09-250760 | * | 9/1997 |
| JP | 2000-240947 | * | 9/2000 |
| KR | 1019960004219 | | 3/1996 |

OTHER PUBLICATIONS

Korean Patent Abstract (KR) No. 1019960004219, Publication. Date. Mar. 28, 1996.

* cited by examiner

*Primary Examiner*—Philip H. Leung
(74) *Attorney, Agent, or Firm*—Sughrue Mion, PLLC

(57) ABSTRACT

A microwave oven is adapted to hingeably couple a door to an oven body, while preventing microwaves from leaking between a door frame and a shield plate included in the door. The microwave oven includes a door hinge bracket having a pair of door-side hinge members and a connecting member adapted to connect the door-side hinge members such they have an integral structure. At a front surface portion thereof, on which the door hinge bracket is fitted, the shield plate is provided with a stepped portion for receiving a portion of the door hinge bracket.

3 Claims, 3 Drawing Sheets

DOOR HINGE ASSEMBLY FOR A MICROWAVE OVEN

CROSS-REFERENCE TO RELATED APPLICATION

This application claims the benefit of Korean Patent Application No. 2003-53167, filed on Jul. 31, 2003 in the Korean Intellectual Property Office, the disclosure of which is incorporated herein by reference.

BACKGROUND OF THE INVENTION

1. Field of the Invention

An apparatus consistent with the present invention relates to a microwave oven and, more particularly, to a microwave oven capable of simply achieving mounting of door-side hinge members adapted to hingeably couple a door to an oven body, while preventing microwaves from leaking to the exterior.

2. Description of the Related Art

Generally, a microwave oven is a cooking appliance in which microwaves emitted from a magnetron are irradiated into a cooking chamber to change repeatedly the arrangement of water molecules in food contained in the cooking chamber, thereby causing the food to be cooked by inter-frictional heat of those water molecules.

Such a microwave oven includes an oven body partitioned into a cooking chamber and an electric element chamber. The electric element chamber receives a magnetron for emitting microwaves in accordance with an oscillation operation thereof, and irradiating the microwaves into the cooking chamber, and a high-voltage transformer for applying high voltage to the magnetron.

A door adapted to open and close the cooking chamber is hingeably coupled to the oven body in front of the cooking chamber. For the hinge coupling of the door, a pair of body-side hinge members respectively provided with hinge holes are provided on one side edge of an opened front end portion of the oven body at upper and lower positions thereof. Also, a pair of door-side hinge members are provided on the door at positions corresponding to those of the body-side hinge members, respectively. The door-side hinge members have hinge shafts adapted to be hingeably coupled with the hinge holes of the body-side hinge members, respectively.

The door includes a door frame centrally provided with a transparent portion, and adapted to define the appearance of the door, a shield plate mounted to an inner surface of the door frame, and adapted to prevent leakage of microwaves, and a cover adapted to cover a region where the shield plate is mounted to the door frame.

The shield plate is provided, at a peripheral edge thereof, with choke slits for shielding leakage of microwaves. The door-side hinge members are coupled to upper and lower portions of one side edge of the shield plate, respectively.

Each door-side hinge member has a hinge shaft support portion, from which the hinge shaft of the door-side hinge member extends, and an extension extending, in a bent state, from an end of the hinge shaft support portion toward a front surface of the shield plate. The extension is welded, at a desired portion thereof, to the front surface of the shield plate, so that the door-side hinge member is fixedly mounted to the shield plate.

When the door-side hinge members are coupled to the body-side hinge members such that the hinge shafts are fitted in the hinge holes, respectively, the door is hingeably coupled to the front end of the door body.

In such a conventional microwave oven, however, there is a drawback in that the door-side hinge members must be individually welded to the shield plate, so that there is an increase in the number of welding processes causing an increased difficulty in mounting of the door-side hinge members.

Furthermore, a step is formed between the shield plate and each door-side hinge member coupled thereto. Due to this step, the front surface of the shield plate cannot come into close contact with the inner surface of the door frame, so that a gap is formed between the door frame and the shield plate. Where such a gap is large, there may be a problem in that microwaves leak to the exterior through the gap.

SUMMARY OF THE INVENTION

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

The present invention has been made in view of the above mentioned problems, and an aspect of the invention is to provide a microwave oven capable of simply achieving mounting of door-side hinge members adapted to hingeably couple a door to an oven body, while preventing microwaves from leaking to the exterior.

An apparatus consistent with the present invention is accomplished by providing a microwave oven comprising an oven body defined therein with a cooking chamber while being opened at a front end thereof, a door hingeably coupled to the front end of the oven body to open and close the cooking chamber, a pair of bodyside hinge members provided at the oven body, each of the body-side hinge members being provided with one of a hinge hole and a hinge shaft, and a pair of door-side hinge members provided at the door, each of the door-side hinge members being provided with the remaining one of the hinge hole and hinge shaft, the microwave oven further comprising; a door hinge bracket provided at the door, the door hinge bracket including the door-side hinge members, and a connecting member adapted to connect the door-side hinge members such that they have an integral structure.

The door may include a door frame defining an appearance of the door while having a transparent portion, and a shield plate coupled to the door frame inside the door frame, and adapted to shield leakage of microwaves. The door hinge bracket may be coupled to the shield plate such that it is fitted around one side edge portion of the shield plate at a front surface of the shield plate. The shield plate may be provided, at the front surface thereof, with a stepped portion for receiving a portion of the door hinge bracket such that the front surface of the shield plate is flush with a front surface of the door hinge bracket in a state in which the door hinge bracket is coupled to the shield plate.

The stepped portion may have a recess structure having a predetermined depth.

The connecting member may have a side connecting portion adapted to be fitted on a side surface of the side edge portion of the shield plate, and a front connecting portion adapted to fitted on a front surface of the side edge portion of the shield plate. The predetermined depth of the stepped portion may correspond to a thickness of the front connecting portion.

BRIEF DESCRIPTION OF THE DRAWINGS

The above aspects, and other features and advantages of the present invention will become more apparent after reading the following detailed description when taken in conjunction with the drawings, in which.

DETAILED DESCRIPTION OF THE ILLUSTRATIVE, NON-LIMITING EMBODIMENTS OF THE INVENTION

Illustrative, non-limiting embodiments of the present invention will now be described in detail with reference to the accompanying drawings.

Figure 1:
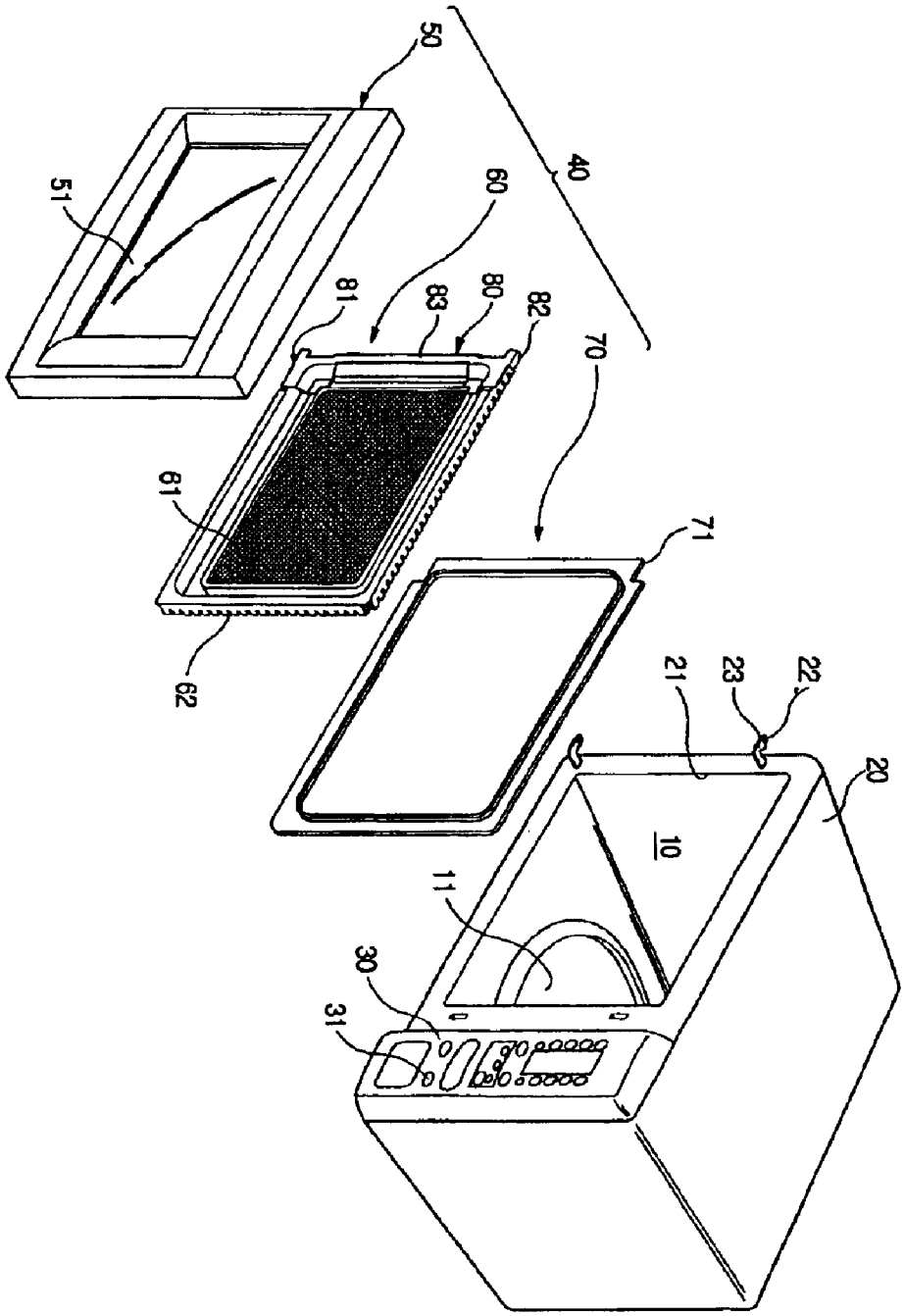
FIG. 1 is a perspective view of the overall configuration of a microwave oven according to an exemplary embodiment of the present invention, illustrating an oven door in an exploded state.

Referring to FIG. 1, a microwave oven according to an embodiment of the present invention is illustrated. As shown in FIG. 1, the microwave oven includes an oven body 20 partitioned into a cooking chamber 10 and an electric element chamber (not shown). The electric element chamber receives a magnetron (not shown) for emitting microwaves in accordance with an oscillation operation thereof, and irradiating the microwaves into the cooking chamber 10, and a high-voltage transformer (not shown) for applying high voltage to the magnetron. A cooking tray 11 is installed in the cooking chamber 10 such that it is rotatable by a motor (not shown). A control panel 30 is mounted to the body 20 in front of the electric element chamber (not shown). The control panel 30 is provided with a plurality of operating buttons 31 to operate various functions of the microwave oven. An opening 21 is formed at the oven body 10 in front of the cooking chamber 10 to allow food to be put into or taken out of the cooking chamber 10.

A door 40 is coupled to a front end portion of the oven body 20 defining the opening 21, in order to open and close the cooking chamber 10. The coupling of the door 40 is implemented by a hinge coupling so that the door 40 is hingeable through a certain angle.

For the hinge coupling of the door 40, a pair of body-side hinge members 23 respectively provided with hinge holes 22 are provided at upper and lower positions on one side edge of the front end portion of the oven body 20 defining the opening 21. Also, a door hinge bracket 80 is provided at the door 40. The door hinge bracket 80 includes a pair of door-side hinge members 82 respectively adapted to be coupled with the body-side hinge members 23, and provided with hinge shafts 81, and a connecting member 83 for connecting the door-side hinge members 82 such that they have an integral structure.

The door 40, which is provided with the door hinge bracket 80, includes a door frame 50 having a box-shaped structure opened at a rear surface thereof, and defining the appearance of the door 40, a planar shield plate 60 coupled to the door frame 50 inside the door frame 50, and adapted to prevent leakage of microwaves, and a cover 70 adapted to cover coupled portions of the door frame 50 and shield plate 60.

The door frame 50 is provided, at a central portion thereof, with a transparent portion 51 for allowing the user to view the interior of the cooking chamber 10 from the outside. The shield plate 60 is provided, at a central portion thereof, with a screen portion 61 having a net structure capable of allowing the user to view the interior of the cooking chamber 10 from the outside, similarly to the transparent portion 51, while shielding microwaves. In order to shield microwaves, together with the screen portion 61, chock slits 62 are arranged at a rear surface of the shield plate 60 along a peripheral edge portion thereof while being uniformly spaced apart from one another. The peripheral edge portion of the shield plate 60 has a structure inwardly bent several times.

In order to couple the shield plate 60 to the door frame 50, engagement protrusions (not shown) are provided at the rear surface of the door frame 50. The engagement protrusions are engaged with portions of the shield plate 60 arranged between adjacent ones of the choke slits 62, respectively. In accordance with this engagement, the shield 60 is firmly coupled to the door frame 50 in such a manner that a front surface of the shield plate 60 is in contact with a corresponding rear surface portion of the door frame 50. In this state, the cover 70 is coupled to the shield plate 60 so that it covers the coupled portions of the door frame 50 and shield plate 60. Thus, the assembly of the door 40 is completed. Prior to the coupling of the shield plate 60 to the door frame 50, the door hinge bracket 80 is coupled to the shield plate 60 such that it is fitted around one side edge portion of the shield plate 60 at the front surface of the shield plate 60. In FIG. 1, reference numeral 71 designates cutouts formed at portions of the cover 70 corresponding to respective door-side hinge shafts 81, and adapted to expose the hinge shafts 81 therethrough, thereby allowing the hinge shafts 81 to be fitted in respective body-side hinge holes 22.

Figure 2:
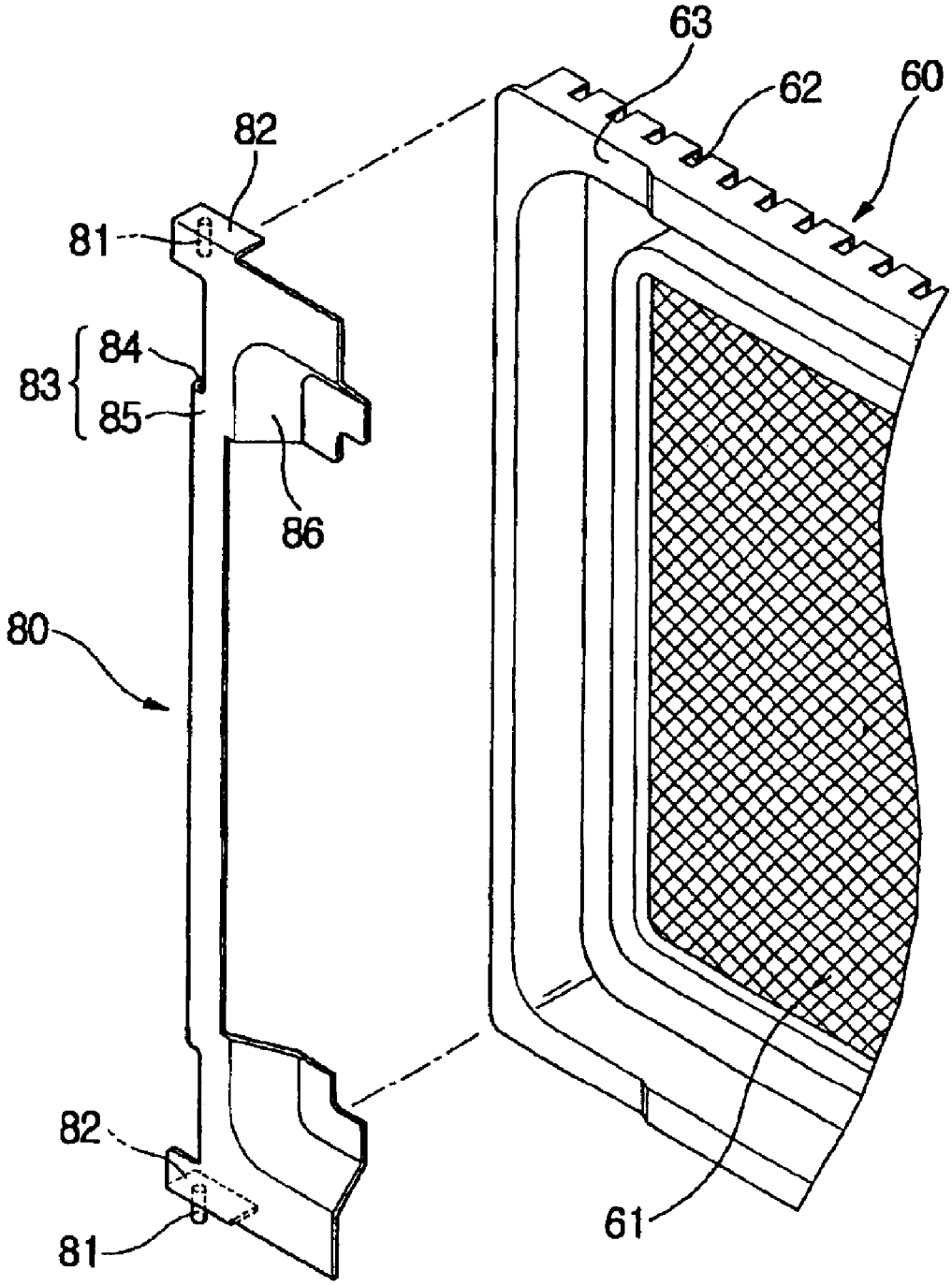
FIG. 2 is a perspective view illustrating a shield plate and a door hinge bracket included in the oven door according to the exemplary embodiment of the present invention in an exploded state.

As shown in an enlarged state in FIG. 2, the door-side hinge members 82 of the door hinge bracket 80 are positioned at upper and lower ends of one side edge portion of the shield plate 60, respectively, while being connected by the connecting member 83 such that they have an integral structure. The hinge shaft 81 of each door-side hinge member 82 extends downwardly from a lower surface of the door side hinge member 82. In particular, the upper one of the door-side hinge members 82 is arranged such that it is upwardly spaced apart from an upper end of the shield plate 60 by a predetermined distance to provide a space allowing the formation of the associated hinge shaft 81.

The connecting member 83 has a side connecting portion 84 adapted to be fitted on a side surface of the side edge portion of the shield plate 60 to be fitted in the connecting member 83, and a front connecting portion 85 adapted to be fitted on a front surface of the side edge portion of the shield plate 60. The connecting member 83 also has welding portions 86 respectively arranged at opposite ends of the front connecting portions 85. The door hinge bracket 80 is welded, at desired regions thereof, to the front surface of the shield plate 60, so that it is firmly fixed to the shield plate 60. For an enhanced weldability, the welding portions 86 are desired to have a shape conforming to the shape of the front surface of the shield plate 60, which is concave at a certain portion thereof while being convex at another certain portion thereof, due to the formation of the choke slits 62.

With the above described structure of the door hinge bracket 80 with the upper and lower door-side hinge members 82 being integral with each other by the connecting member 83, the upper and lower door-side hinge members 82 can be simultaneously fixed to the shield plate 60 through a single-pass welding process. Thus, it is possible to more simply achieve the mounting of the door-side hinge members 82.

Figure 3:
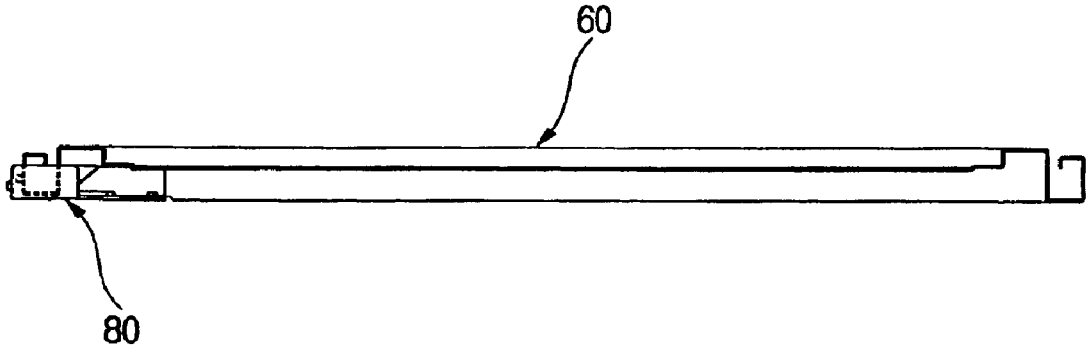
FIG. 3 is a plan view illustrating a coupled state of the shield plate and door hinge bracket in the oven door according to the exemplary embodiment of the present invention.

The front surface portion of the shield plate 60, on which the front connecting portion 85 of the door hinge bracket 80 is fitted, is recessed to a predetermined depth to define a stepped portion 63 for receiving the front connecting portion 85 when the door hinge bracket 80 is coupled to the shield plate 60, such that the front surface of the shield plate 60 is flush with the front surface of the door hinge bracket 80. By virtue of the stepped portion 63, the front surface of the shield plate 60, which is to be fitted on a corresponding rear surface portion of the door frame 50, is planar without having any step, in a state in which the door hinge bracket 80 is coupled to the shield plate 60, as shown in FIG. 3. Accordingly, the shield plate 60 can be firmly coupled to the door frame 50. Also, no gap is formed between the door frame 50 and the shield plate 60. Thus, the stepped portion 63 also serves to prevent microwaves in the cooking chamber 10 from leaking to the exterior.

That is, the shield plate 60, to which the door hinge bracket 80 has been welded, is coupled to the door frame 50. The coupling of the shield plate 60 to the door frame 50 is carried out by positioning the shield plate 60 inside the door frame 50 at the rear side of the door frame 50, and pressing the door frame 50 and shield plate 60 toward each other such that the front surface of the shield plate 60 comes into contact with the corresponding rear surface portion of the door frame 50. At this time, the front surface of the shield plate 60 comes into close contact with the corresponding rear surface portion of the door frame 50 without forming any gap therebetween. This is because the shield plate 60 is planar without having any step by virtue of the stepped portion 63, even though the door hinge bracket 80 has been coupled thereto. Thus, the shield plate 60 is firmly coupled to the door frame 50. Where the shield plate 60 is coupled to the door frame 50 without forming any gap therebetween, as described above, there is no possibility that microwaves leak externally between the door frame 50 and the shield plate 60. Accordingly, it is possible to reduce loss of microwaves. For reference, it is desirable that the stepped portion 63 of the shield plate 60 has a depth corresponding to the thickness of the front connecting portion 85 of the door hinge bracket 80 so that the front surface of the shield plate 60 is completely planar.

Although not shown, the hinge holes 22 may be provided at respective door-side hinge members 82, whereas the hinge shafts 81 may be provided at respective body-side hinge members 23. In this case, the door 40 can be hingeably coupled to the oven body 20, similarly to the above described case. The door hinge bracket 80 provided at the door 40 also has the same configuration as that of the above described case, except that the door-side hinge members 82 thereof are provided with respective hinge holes 22. When the door hinge bracket 80 is coupled to the shield plate 60 provided with the stepped portion 63, the same effect as that of the above described case is obtained.

The procedure of assembling the door 40 in the microwave oven having the above described configuration according to the illustrated embodiment of the present invention, and the effect obtained by the configuration will now be described.

The door hinge bracket 80 with the upper and lower, door-side hinge members 82 being integral with each other by the connecting member 83 can be coupled to the shield plate 60 through a single-pass welding process. Accordingly, the mounting of the door-side hinge members 82 can be more simply achieved.

The shield plate 60, to which the door hinge bracket 80 has been coupled, is then coupled to the door frame 50. At this time, the shield plate 60 can come, at the front surface thereof, into close contact with the corresponding rear surface portion of the door frame 50 because the front connecting portion 85 of the door hinge bracket 80 is received in the stepped portion 63 formed at the front surface of the shield plate 60, so that the front surface of the shield plate 60 is rendered planar without having any step. Accordingly, the shield plate 60 can be firmly coupled to the door frame 50. Under the condition in which the shield plate 60 is coupled to the door frame 50 without forming any gap therebetween, as described above, there is no possibility that microwaves leak externally between the door frame 50 and the shield plate 60.

As apparent from the above description, the microwave oven according to the present invention includes the door hinge bracket having a pair of door-side hinge members, and the connecting member adapted to connect the door-side hinge members such they have an integral structure, so as to simultaneously mount the door-side hinge members to the door through a single-pass welding process. Accordingly, the mounting of the door-side hinge members can be simply achieved.

The front surface portion of the shield plate, on which the door hinge bracket is fitted, is provided with the stepped portion for receiving a desired portion of the door hinge bracket, so that the front surface of the shield plate is planar without having any step in a state in which the door hinge bracket is coupled to the shield plate. Accordingly, the front surface of the shield plate can come into close contact with the corresponding rear surface portion of the door frame. Thus, the shield plate can be firmly coupled to the door frame. Also, there is no possibility that microwaves leak externally between the door frame and the shield plate.

Although the exemplary embodiments of the invention have been disclosed for illustrative purposes, those skilled in the art will appreciate that various modifications, ns are possible, without departing from the scope and spirit of the the accompanying claims.

What is claimed is:

1. A microwave oven comprising:

an oven body defined therein with a cooking chamber while being opened at a front end thereof;

a door hingeably coupled to the front end of the oven body;

a pair of body-side hinge members provided at the oven body, each of the body-side hinge members being provided with at least one of a hinge hole and a hinge shaft;

a pair of door-side hinge members provided at the door, each of the door-side hinge members being provided with the other of the hinge hole and hinge shaft;

a door hinge bracket provided at the door, the door hinge bracket including the door-side hinge members; and a connecting member adapted to connect the door-side hinge members as an integral structure, wherein:

the door includes a door frame having a transparent portion and a shield plate coupled to the door frame inside the door frame;

the door hinge bracket is coupled to the shield plate and is fitted around a side edge portion of the shield plate at a front surface of the shield plate; and the shield plate is provided, at the front surface thereof, with a stepped portion for receiving at least a portion of the door hinge bracket such that the front surface of the shield plate is substantially flush with a front surface of the door hinge bracket when the door hinge bracket is coupled to the shield plate.

2. The microwave oven according to claim 1, wherein the stepped portion has a recess structure having a predetermined depth.

3. The microwave oven according to claim 2, wherein:

the connecting member has a side connecting portion adapted to be fitted on a side surface of the side edge portion of the shield plate and a front connecting portion adapted to fitted on a front surface of the side edge portion of the shield plate; and the predetermined depth of the stepped portion corresponds to a thickness of the front connecting portion.

* * * * *